US012163300B2

(12) United States Patent
McPherson et al.

(10) Patent No.: US 12,163,300 B2
(45) Date of Patent: Dec. 10, 2024

(54) METHOD AND APPARATUS FOR MECHANICAL CONNECTION BETWEEN AN OFFSHORE STRUCTURE AND A SUBSEA PILE

(71) Applicants: Caley Ocean Systems Limited, Strathclyde (GB); Houlder Limited, London (GB)

(72) Inventors: Gregor McPherson, Glasgow (GB); Luiz Demenicis, London (GB)

(73) Assignees: CALEY OCEAN SYSTEMS LIMITED, Strathclyde (GB); HOULDER LIMITED, London (GB)

( * ) Notice: Subject to any disclaimer, the term of this patent is extended or adjusted under 35 U.S.C. 154(b) by 273 days.

(21) Appl. No.: 17/609,239

(22) PCT Filed: May 7, 2020

(86) PCT No.: PCT/GB2020/051117
§ 371 (c)(1),
(2) Date: Nov. 5, 2021

(87) PCT Pub. No.: WO2020/225561
PCT Pub. Date: Nov. 12, 2020

(65) Prior Publication Data

US 2022/0205204 A1 Jun. 30, 2022

(30) Foreign Application Priority Data

May 7, 2019 (GB) ..... 1906375

(51) Int. Cl.
*E02B 17/00* (2006.01)
*E02D 27/52* (2006.01)

(52) U.S. Cl.
CPC .. *E02B 17/0008* (2013.01); *E02B 2017/0043* (2013.01); *E02B 2017/0073* (2013.01); *E02D 27/525* (2013.01)

(58) Field of Classification Search
CPC ..... E02B 17/0008; E02B 2017/0043; E02B 2017/0073; E02D 27/525
See application file for complete search history.

(56) References Cited

U.S. PATENT DOCUMENTS 4,269,543 A * 5/1981 Goldman ..... E02B 17/021 254/89 R
4,867,612 A * 9/1989 Bassett ..... E02B 17/06 405/199

(Continued)

FOREIGN PATENT DOCUMENTS

FR 2372277 A1 6/1978
FR 2372277 A * 7/1978 ..... E02B 17/00
GB 2425328 A * 10/2006 ..... B66F 1/02

OTHER PUBLICATIONS

International Search Report and Written Opinion for corresponding PCT Application No. PCT/GB2020/051117, mailed Sep. 23, 2020.

*Primary Examiner* — Janine M Kreck
(74) *Attorney, Agent, or Firm* — Tarolli, Sundheim, Covell & Tummino LLP

(57) ABSTRACT

A method for connecting an offshore structure (2) to a subsea pile (1) includes inserting a connecting portion (14) of the structure inside the subsea pile. The connecting portion (14) comprises a plurality of outwardly moveable clamping members (5). Moving each of the plurality of clamping members (5) into gripping contact with an inside surface of the subsea pile provides a mechanical connection. The method may also include a grouting step to make the connection permanent.

20 Claims, 6 Drawing Sheets

(56) References Cited

U.S. PATENT DOCUMENTS

| | | | | |
|---|---|---|---|---|
| 2015/0368871 | A1 | 12/2015 | Seidel | |
| 2021/0123202 | A1* | 4/2021 | Lebon | E02D 13/00 |
| 2021/0324599 | A1* | 10/2021 | West | E02D 27/52 |

* cited by examiner

METHOD AND APPARATUS FOR MECHANICAL CONNECTION BETWEEN AN OFFSHORE STRUCTURE AND A SUBSEA PILE

RELATED APPLICATIONS

The present invention is a U.S. National Stage under 35 USC 371 patent application, claiming priority to Serial No. PCT/GB2020/051117, filed on 7 May 2020; which claims priority from 1906375.9, filed 7 May 2019, which are incorporated herein by reference.

FIELD

The present invention relates to apparatus and methods for connecting an offshore structure to one or more sub-sea piles. The offshore structure may be a jacket for an oil and gas platform or a mast or other structure for a wind turbine installation.

BACKGROUND

A typical (prior art) assembly is shown in FIGS. 1 and 1*a*. A critical element in the installation of offshore structures is the connection between the sub-sea pile 1 in the seabed 3 and the structure 2 that extends above (a 'jacket' i.e. a substructure for supporting e.g. an oil platform is depicted in the figure).

A common arrangement for these structures involves a single, or multiple, circular pile(s) 1 driven into the seabed 3 onto which the structure 2 is then placed. The structure will often have elements, (such as leg, or leg extension or 'stab in' 6—FIG. 1*a*), which extend down inside the pile 1 and which serve to locate the structure on the piles as well as provide an area of overlap.

The gap 4 between this element 6 and the inside of the pile 1 is ultimately filled with a cement or cement-like medium commonly referred to as grout. This grout is introduced into the annular void 4 in the form of a fluid and solidifies over a period of time to become a rigid solid material.

It is understood that, if unconstrained, the structure and the pile will move relative to each other possibly due to the action of waves or other environmental conditions specific to the location of the installation. If this relative movement occurs once the grout is in place but before the grout is solid, that this can have an undesired and detrimental effect on the mechanical strength of the final solid grout. A weak connection could compromise the life span of the offshore structure and cause it to fail prematurely or unexpectedly with dire implications for damage to equipment, the environment, or even loss of life.

It is therefore very important that the relative movement between the structure and the pile is limited as much as possible during the time required for the grout to become solid. A temporary method of securing the structure to the pile needs to be employed.

Current solutions to this involve a clamp like device attached to the structure which acts on the outer circumference of the pile 1 at the top. However, the element 6 of the structure inside the pile 1 is required to extend some distance towards the seabed from the top of the pile to provide sufficient surface area for the grout to form a bond. The current design of clamps only limit movement over a localised area at the top of the pile.

It is generally regarded that the main strength of the final grouted connection is not at the top of the gap 4 between the structure 2 and pile 1 but rather some distance further down towards the seabed 3. Existing clamp designs do not act directly at the area where restriction of relative movement is most critical. Since these existing clamp designs were first envisaged there has been increased understanding of the effects of even small relative movements on the final grout strength and consequently much stricter guidance on the allowable movement by certifying authorities.

Existing designs for clamps also necessitate the building of an additional fabrication to hold the clamp elements, commonly hydraulic cylinders (hydraulically powered piston in cylinder arrangements) are employed. This fabrication is then joined to the main structure often by means of welding which can be time consuming.

In order to meet new requirements on minimum allowable deflections, the clamp fabrications have become more difficult to design, of a more complex construction and, consequently, often more expensive to manufacture. Also, because these clamps are not acting directly in the most critical area, it can be argued that even if it were possible for these clamps to be 100% rigid when in use, their effectiveness is significantly limited due to the potential for the main structure to flex or distort over the distance between the clamp and the most critical area for the final strength of the solid grout.

There is therefore the need for improved connection methods.

SUMMARY

According to a first aspect the present invention provides a method for connecting an offshore structure to a subsea pile, the method comprising:

a) inserting a connecting portion of the structure inside the subsea pile, wherein the connecting portion comprises a plurality of outwardly moveable clamping members; and b) outwardly moving each of the plurality of clamping members into gripping contact with an inside surface of the subsea pile.

Typically, the subsea pile may be generally cylindrical in form. The connecting portion of the structure may be an end of a jacket leg or other, typically tubular, typically cylindrical in cross section, member. Tubular, generally cylindrical connecting portions are often used for connecting to a subsea pile where a grouting procedure is to be employed to provide an essentially permanent connection. For example, the connecting portion may be the end, or attached at the end, of a tubular mast for a wind turbine installation. Alternative connecting portions are also contemplated e.g. a steel beam or a steelwork lattice arrangement (pipe or girders), that is part of the structure to be connected to the pile.

The connection provided by the method may be temporary. The method provided may include further steps, for example a grouting step or a welding step, to form a permanent or substantially permanent connection between the structure and the subsea pile.

Each of the plurality of clamping members is outwardly moveable. The clamping members may also be retractable. Retractable clamping members can find use in methods including a grouting step, or where the connection is only temporary, as discussed further hereafter.

The clamping members may be spaced apart on the connecting portion, so as to contact the inside surface of the pile at spaced apart locations about its circumference and/or at axially spaced locations along a length of the pile when operated. Such arrangements can allow the connecting portion to connect rigidly or relatively rigidly to the subsea pile, with an annular space in between. Such arrangements can provide a connection that is notably secure and suitably rigid, even if the structure and pile are subject to significant stress from e.g. strong wave motions.

The plurality of clamping members may be distributed on the connecting portion so as to contact the inside surface of the pile at substantially equally spaced intervals around its circumference when operated. Arrangements where the clamping members are not at equally spaced intervals are also contemplated. For example, different spacing arrangements may be provided so as to to respond appropriately to the anticipated forces where the structure, or forces applied to the structure, apply uneven loadings to the connection with the pile.

Clamping members may be fitted to a connecting portion in opposed pairs, to produce diametrically opposed gripping forces acting on the inside surface of the subsea pile.

The plurality of clamping members may comprise a first and second group of of clamping members. For example, a first group may be provided on the connecting portion at one location along its length, and a second group of the plurality of clamping members provided at a different location along the length of the connecting portion. The members of each group of clamping members may be arranged to contact the inside surface of a subsea pile at spaced apart locations about its circumference.

The clamping members move outwardly into gripping contact with an inside surface of the subsea pile. Some optional features of the clamping arrangements are discussed below.

To aid in the gripping action, a clamping member may comprise a contact surface that is shaped to conform to the inside surface of the pile. For example, a curved contact surface can conform to the curvature of a typical cylindrical tubular pile. It may also be advantageous to provide clamping members with contact surfaces that are textured, for example with protrusions and/or ridges to increase the coefficient of friction between the clamping member and subsea pile. The inner surface of the subsea pile may itself be textured to improve grip.

The clamping members may take different forms and be operated in different ways. Conveniently a clamping member may comprise a piston that extends from a hydraulic cylinder assembly i.e. a clamping assembly that can be fitted to the connecting portion of a structure may comprise a hydraulic piston in cylinder arrangement. The clamping member may consist of, or consist essentially of, the piston. An end of the piston may contact the inside surface of the subsea pile. The end of the piston may have a shaped and/or textured contact surface. The end of the piston may have a shaped and/or textured contact surface element fitted to it. When powered by fluid pressure from a suitable hydraulic circuit the piston extends until the contact surface of the piston end, or the contact surface of the contact surface element, engages an inside surface of the subsea pile with gripping contact.

The use of such hydraulic arrangements can allow the application of substantial clamping pressure in a controllable way. The hydraulic pressure employed can be locked into the hydraulic circuit to allow continuing pressure, without requiring continuing use of a pump. Furthermore, the pressure in the hydraulic circuit can be monitored remotely from the location of the piston and cylinder arrangement.

Where hydraulic cylinder arrangements are employed, the piston may be double acting, with hydraulic fluid being deliverable to either side of the piston body part that makes sealing contact with the cylinder wall, so that the piston can be retracted as well as extended outwards.

One or more a hydraulic piston in cylinder arrangements may be provided to form a clamping assembly, for fitting to the connecting portion of a structure.

Clamping assemblies that comprise a hydraulic cylinder and piston arrangement can be fitted separately to the connecting portion of the structure.

In a convenient arrangement a clamping assembly may comprise a single cylinder having a piston extendable from each end. The cylinder is divided by a wall between the two pistons into two chambers, to separate the hydraulic pressure experienced by each piston. Such a 'double ended' assembly can be fitted to a connecting portion to provide diametrically opposed gripping forces acting on the inside surface of the subsea pile.

In a similarly convenient arrangement, that can be more economical in manufacture, two cylinders may be employed, each fitted to an end of a clamping assembly member, for example fitting into either end of a cylindrical tube. A piston extends outwardly from each cylinder of the assembly. The cylinders are fitted so that the pistons extend outwards in opposite directions. This form of double ended assembly can also be fitted to a connecting portion to provide diametrically opposed gripping forces acting on the inside surface of the subsea pile.

As an alternative to clamping assemblies employing hydraulic piston in cylinder arrangements screw jack arrangements may be employed in a similar fashion to provide outwardly moveable clamping members. The clamping member may comprise, consist of, or consist essentially of, the screw. An end of the screw may contact the inside surface of the subsea pile. The end of the screw may have a shaped and/or textured contact surface. The end of the screw may have a shaped and/or textured contact surface element fitted to it. The screw jacks may be electrically or more preferably hydraulically powered. When powered the screw extends until the contact surface of the screw end, or the contact surface of the contact surface element, engages an inside surface of the subsea pile with gripping contact.

Clamping assemblies that comprise a screw jack arrangement can be fitted separately to the connecting portion of the structure. Alternatively, a double ended arrangement may be provided. That is to say a clamping assembly comprising two screw jacks may be employed, each fitted to an end of a clamping assembly member, for example fitting into either end of a cylindrical tube. A screw extends outwardly from each jack of the assembly. This form of double ended assembly can also be fitted to a connecting portion to provide diametrically opposed gripping forces acting on the inside surface of the subsea pile.

The method of the first aspect may also comprise a grouting step where grout material is inserted into the annular space between the connecting portion and the inside surface of the pile when they are connected by the clamping members. The grout is then allowed to set. To form a strong grouted connection the grout may be provided along an axial length of the annular space. The axial length may be, for example, several metres, for a large assembly.

In prior art grouting procedures, surface texturing, such as grooves and/or ridges (that may be referred to as 'keys') can be provided along a length on the inside surface of the pile and on a corresponding length of the connecting portion. The surface texturing can aid in providing secure and rigid connection: from pile to layer of grout; and from layer of grout to connecting portion.

In a convenient arrangement a first group of the plurality of clamping members may be provided on the connecting portion above the surface texturing, and a second group of the plurality of clamping members provided below the surface texturing. This can allow the grout connection along the lengths where surface texturing is provided to be without interference from the clamping members. This may aid in providing a more secure connection over the keyed lengths of the connecting portion and pile.

In addition, the axial spacing between the first and second groups of clamping members can provide an initial connection, before grouting, that is notably secure and suitably rigid, even if the structure and pile are subject to significant stress from e.g. strong wave motions.

After the grout has set to a solid, it may be desirable to relieve the pressure applied to the parts of the assembly (subsea pile, connecting portion and clamping members) by the gripping contact between the clamping members and the subsea pile. This may be done, for example by removing an applied hydraulic pressure to reduce the contact pressure to a low or even a zero level. For further example, the clamping members may be retracted, away from contact with the pile. Removing the contact between the clamping members and the subsea pile may also have the advantage of removing electrical connection (conduction paths) between these components which could otherwise give rise to undesired galvanic corrosion.

Typically, where a grouting step is employed the clamping members may be surrounded by grout. If so, on retraction of a clamping member, a void will be left. The method may then include filling the void, for example with fluid, for example supplied from or via the connecting portion.

As described above the connecting method may include a grouting step. Thus, according to a second aspect the present invention provides a method for grouting an offshore structure to a subsea pile, the method comprising:

a) inserting a connecting portion of the structure inside the subsea pile, wherein the connecting portion comprises a plurality of outwardly moveable clamping members;
b) outwardly moving each of the plurality of clamping members into gripping contact with an inside surface of the subsea pile;
c) inserting a grout material into the annular space between the connecting portion and the inside surface of the pile; and
d) allowing the grout material to set.

The grouting method of the second aspect may include all the steps and apparatus described herein with respect to the first aspect except that the grouting method will typically form a permanent or substantially permanent connection, whereas the connection method of the first aspect can be temporary.

Although the methods and apparatus described above are for connecting an offshore structure to a subsea pile, they may be employed in an onshore environment for use in forming temporary or permanent connections between a structure and a pile.

Thus, according to a third aspect the present invention provides a method for connecting a structure to a pile, the method comprising:

a) inserting a connecting portion of the structure inside the pile, wherein the connecting portion comprises a plurality of outwardly moveable clamping members; and
b) outwardly moving each of the plurality of clamping members into gripping contact with an inside surface of the pile.

The method of the third aspect may include all the steps and apparatus described herein with respect to the first and second aspects.

According to a fourth aspect, the present invention provides a clamping assembly for use in the methods of the invention described herein, the clamping assembly comprising two clamping members, each comprising a piston that extends from a hydraulic piston in cylinder arrangement;

wherein each piston in cylinder arrangement is fitted to an end of a clamping assembly member and the pistons extend outwards from the assembly in opposite directions in use. The clamping assembly member may be a cylindrical tube.

SHORT SUMMARY OF THE INVENTION WITH REFERENCE TO THE DRAWINGS

The method of the present invention provides an improved means of limiting movement between the structure 2 and the pile 1 (FIG. 1) by acting directly at the most critical areas. The present invention also removes the need for the complex fabrications required in existing designs.

The present invention functions (FIG. 2) by acting outwards from the element of the structure 2 that extends inside the pile 6 and interfaces with the inside surface of the pile. In this way the clamping members 5 that provide the mechanical connection are not limited in position to being at the top of the pile and can be located lower down and act directly at the most critical areas.

Figure 3:
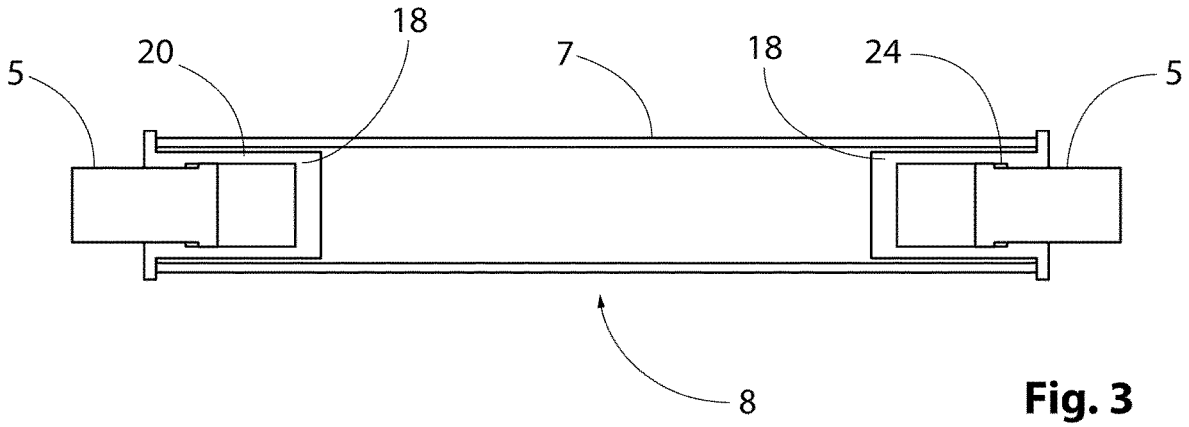
FIG. 3 Shows a pair of hydraulic cylinders incorporated into an intermediate structure 7 to form a clamping assembly 8.

The present invention may comprise two clamping members 5 which are positioned at opposite ends of a simple structure 7 in an extended state (FIG. 3). This unit is passed through holes in the part of the structure 2 that is intended to protrude down inside the pile 1 and securely fixed in place.

Once the structure is in place relative to the pile, the clamping members are extended across the annular gap 4 to exert force in an outwards direction to act on the inner surface of the pile. This has the advantage that the structure 7 between the clamping members 5 is mainly in compression and consequently can be of a simple construction.

The clamping members are preferably hydraulic cylinders which are operated either remotely or locally to the device. These hydraulic cylinders can be incorporated into an intermediate structure 8 such as a tubular construction so that they form a clamping assembly (FIG. 3).

Multiples of these assemblies 8 can be installed at different heights (FIG. 4) and radial angles (FIG. 5) to suit the specific requirements of the overall installation.

When multiples of these assemblies are employed in a single situation the relative positions of the pile and structure can be maintained within a small margin even in opposition to the forces acting on the structure from multiple directions.

Figure 6:
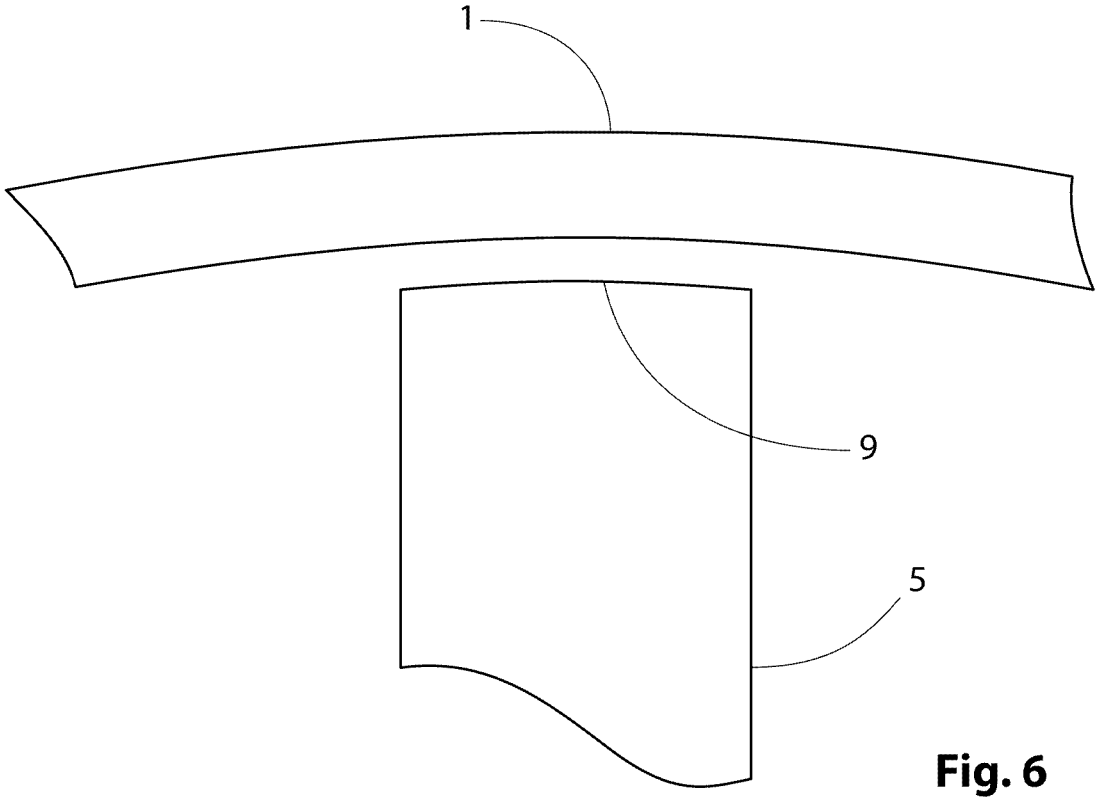
FIG. 6 Shows a cutaway illustration of a pile and clamping member with the end of the clamping member shaped to interface with the pile internal surface as viewed from one end of the pile.

The ends 9 of the clamping members 5 which contact with the inner surface of the pile may be shaped such as to facilitate an even distribution of the force exerted by the member onto the pile (FIG. 6).

Figure 7:
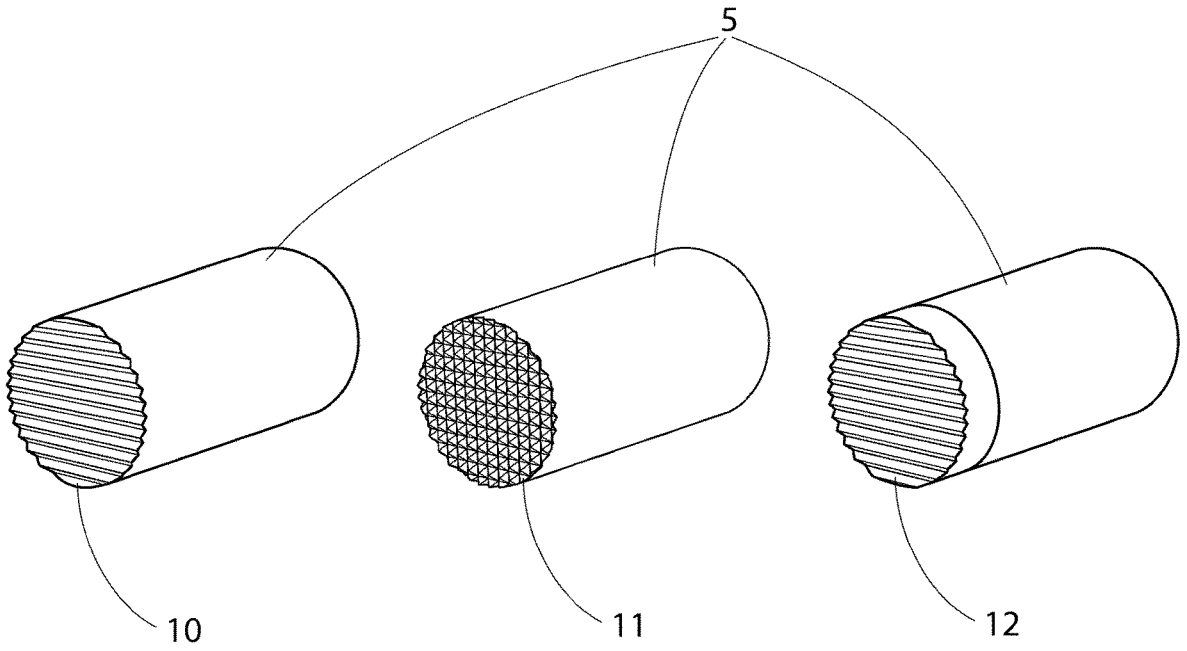
FIG. 7 Shows an illustration of 3 possible different methods for shaping the end of the clamping member that makes contact with the pile, ridges 10, protrusions 11 and the interface formed from a separate piece of material 12 which is then connected to the clamping member 5.
Figure 8:
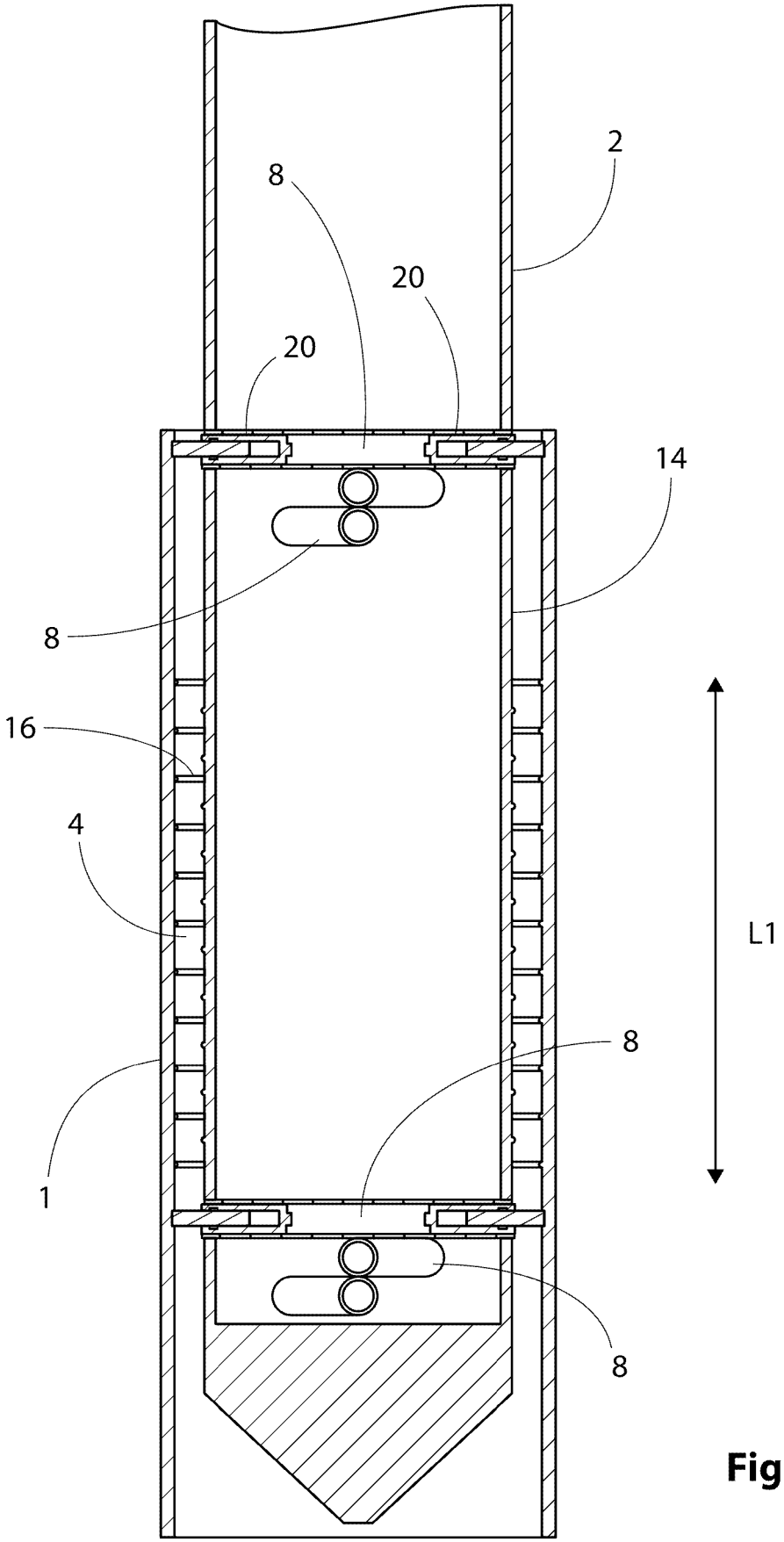
FIG. 8 shows in schematic cross section detail a subsea pile and structure connection in accordance with the invention.

Depending on the requirements of the specific installation it may also be advantageous to shape the ends of the clamping members that contact the pile to be a series of protrusions 11 or ridges 10 such as to increase the coefficient of friction between the clamping member and pile and so resist movement in a direction other than along the primary axis of the member (FIG. 7). Depending on the specific materials employed in the manufacture of the clamping member and pile it may also be advantageous to create this shaped interface from a separate piece of material 12 (FIG. 7) which is then attached to the member. In this manner the properties of different materials can be exploited to further increase the coefficient of friction between the clamping member and pile.

Once the gap 4 has been filled with a suitable medium and that medium has become solid the invention may include a means of withdrawing the clamping members 5 so that they can be retracted to ensure that there is no electrical connection between the pile and structure which could lead to undesired galvanic corrosion.

The invention may also be described as in the following non-limiting numbered clauses.

Numbered Clauses 1) a method of mechanical connection between an offshore structure and subsea pile that acts on the inside surface of the pile in order to resist relative movement between the structure and the pile.

2) a method of mechanical connection between an offshore structure and pile as set out in clause 1, such that the method of connection is achieved by the use of hydraulic cylinders.

3) a method of mechanical connection between an offshore structure and pile as set out in clause 2, such that the hydraulic cylinders are incorporated into the element of the structure that extends down within the pile.

4) a method of mechanical connection between an offshore structure and pile as set out in clause 2, wherein the hydraulic cylinders are incorporated into opposing ends of a intermediate structure.

5) a method of mechanical connection between an offshore structure and pile as set out in clause 3, such that the ends of the rods of the hydraulic cylinders are shaped to match the internal surface of the pile.

6) a method of mechanical connection between an offshore structure and pile as set out in clause 3, such that the external ends of the cylinder rods are shaped in such a way as to present multiples of ridges or protrusions that will contact the inner surface of the pile when the cylinder is extended so as to increase the friction between the cylinder rod end and the inner surface of the pile.

7) a method of mechanical connection between an offshore structure and pile as set out in clause 3, such that the external ends of the cylinder rods are terminated by an additional piece of material that is shaped in such a way as to result in multiples of ridges or protrusions that will contact the inner surface of the pile when the cylinder is extended so as to increase the friction between the cylinder rod end and the inner surface of the pile.

8) a method of mechanical connection between an offshore structure and pile as set out in clause 4, wherein multiple such assemblies are attached to the main structure.

9) a method of mechanical connection between an offshore structure and pile as set out in clause 8, such that the multiple assemblies are positioned at different heights and angles relative to the main axis of the part of the structure to which they are attached.

DETAILED DESCRIPTION OF THE DRAWINGS

Figure 1:
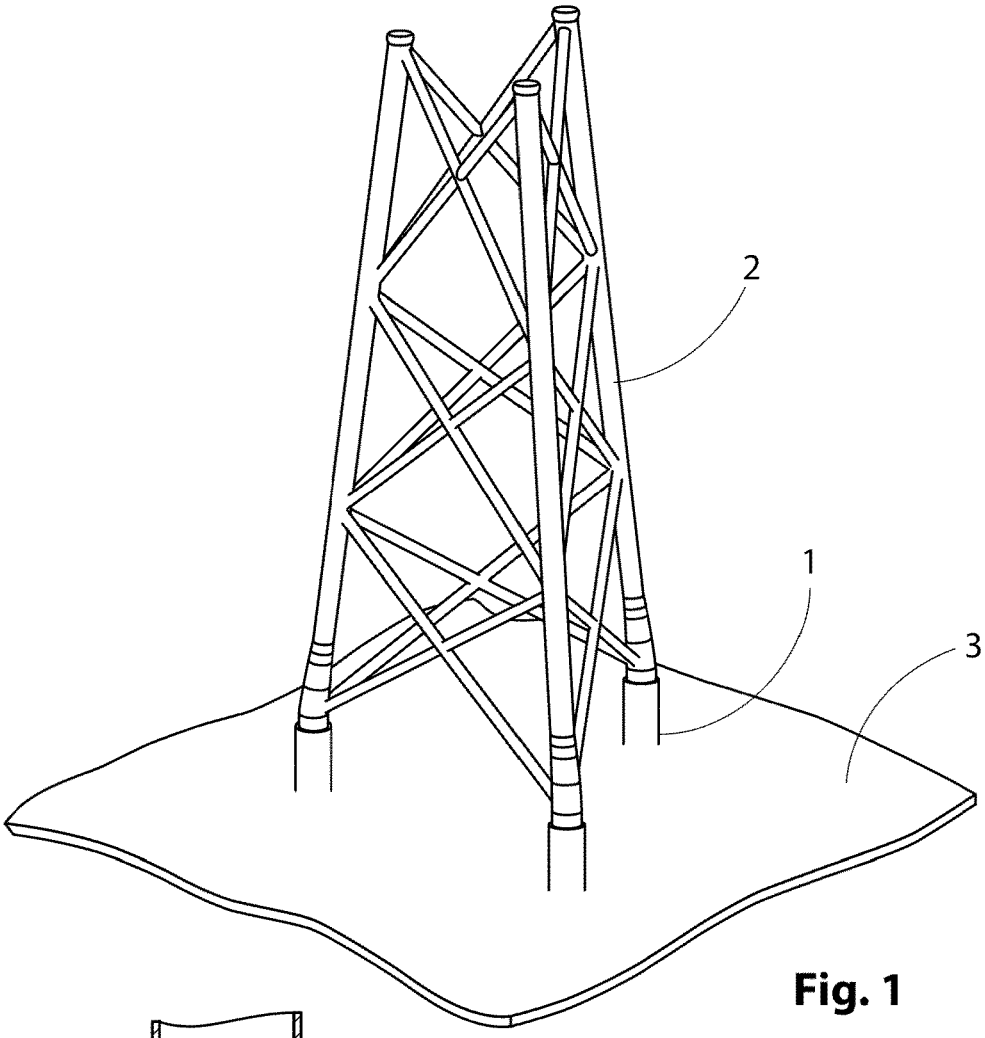
FIG. 1 Shows one possible arrangement of subsea piles 1 and support structure 2 in place on the seabed 3.

FIG. 1 shows a schematic view of a three legged structure 2 (a jacket assembly) with each leg fitting to a pile 1 that has previously been driven into the seabed 3.

Figure 1A:
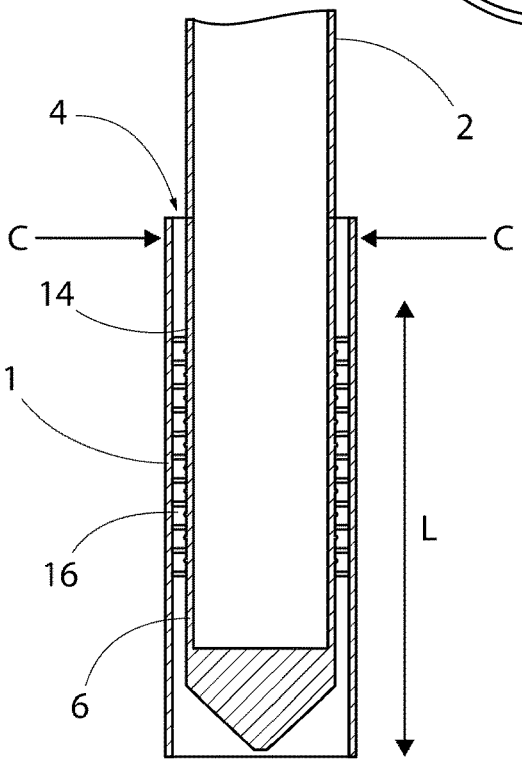
FIG. 1*a* shows in cross section schematic detail a prior art subsea pile and structure connection.

As shown in schematic cross section detail FIG. 1*a*, the leg of the structure 2 has a connecting portion 14 that fits into the interior of the pile 1. In this example the connecting portion 14 is an end of the leg.

The annular space 4 between the connecting portion 14 and the inner surface of the pile 1 can be filled with a grout, for example along a length suggested by double headed arrow L. On setting the grout layer provides a permanent connection between the structure 2 and the pile 1. To ensure good connection with the layer of grout filling annular space 4 a number of grooves and/or ridges 16 are provided along a length of the inside surface of the pile 1 and along a length of the outside surface of the connecting portion 14.

To obtain a strong connection, movement between the connecting portion 14 and the pile 1 during the insertion of the grout and its setting must be prevented as far as possible. The prior art method clamps leg of structure 2 to the outside of pile 1, at or near its top, as suggested by arrows C. Clamping at the top of the pile 1 may be ineffective in preventing motion of the connecting portion 14 at a lower position within the pile 1 if the structure 2 is subject to strong forces e.g. from wave or tidal motion.

Figure 2:
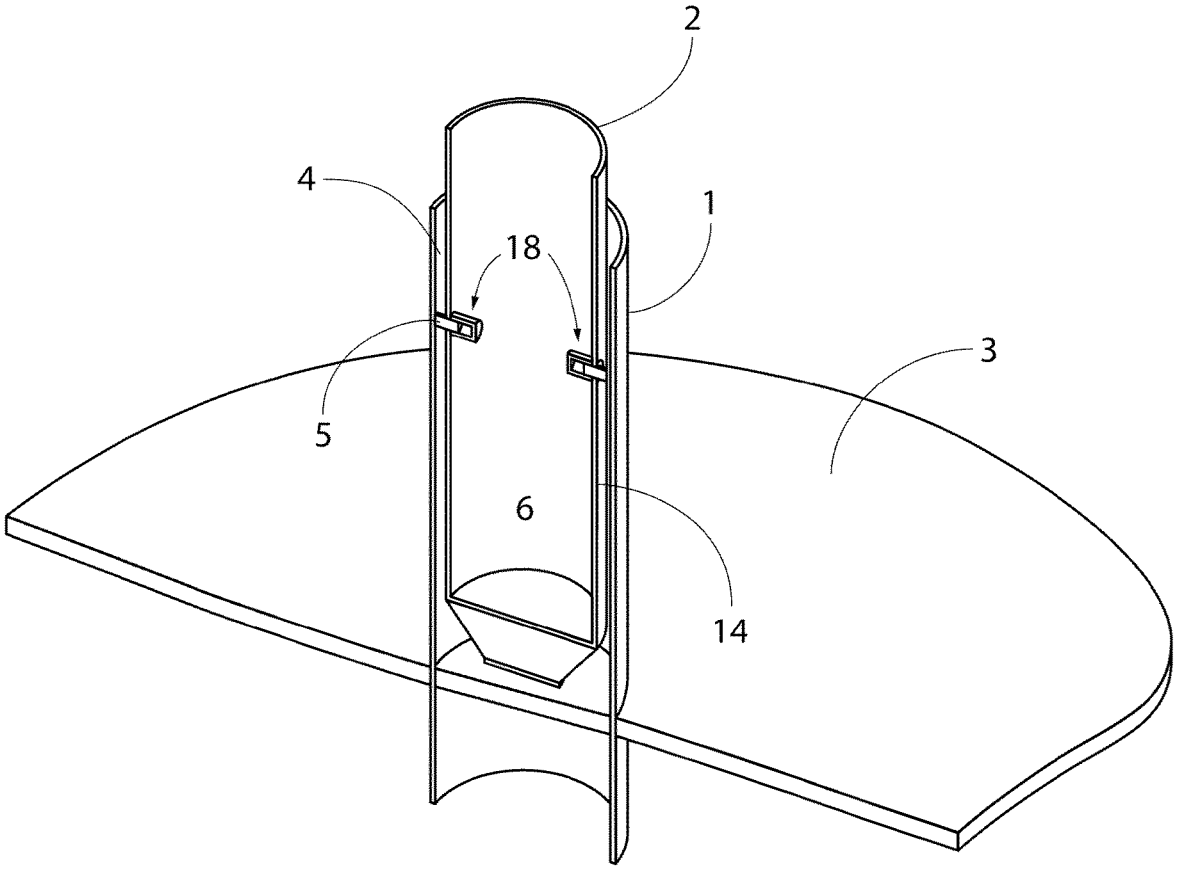
FIG. 2 Shows a cross section of a pile 1 and part of a structure 2 with a single pair of opposed clamping members 5 extended across the annular gap 4.

FIG. 2 shows in schematic perspective a connection arrangement similar to that of FIG. 1 except that a mechanical connection has been made between the connecting portion 14 and the inside surface of the pile 1, before grouting operations commence. The mechanical connection has been made by outward movement of clamping members, which in this example are the pistons 5 of hydraulic cylinder arrangements 18. Two hydraulic cylinder arrangements 18 are shown in FIG. 2, with pistons 5 acting in diametrically opposed directions to give diametrically opposed gripping forces between the inside surface of the pile 1 and the connecting portion of the structure 2.

Schematic cross section FIG. 3 shows a convenient arrangement that may be used, for example in fitting to a tubular connecting portion such as that depicted in FIG. 2. The clamping assembly 8 comprises a tubular structure 7 to which are fitted two opposed hydraulic cylinder arrangements 18. Each hydraulic cylinder arrangement 18 has a hydraulic cylinder 20 mounting piston 5 as a clamping member. The hydraulic cylinders 20 may be screw fitted into tubular structure 7. In this example the pistons 5 are double acting and can be retracted from the outwardly extended position shown by pumping fluid into a small annulus 24 between the piston and cylinder walls. Hydraulic lines for a hydraulic circuit are not shown in these drawings, for clarity.

Figure 4:
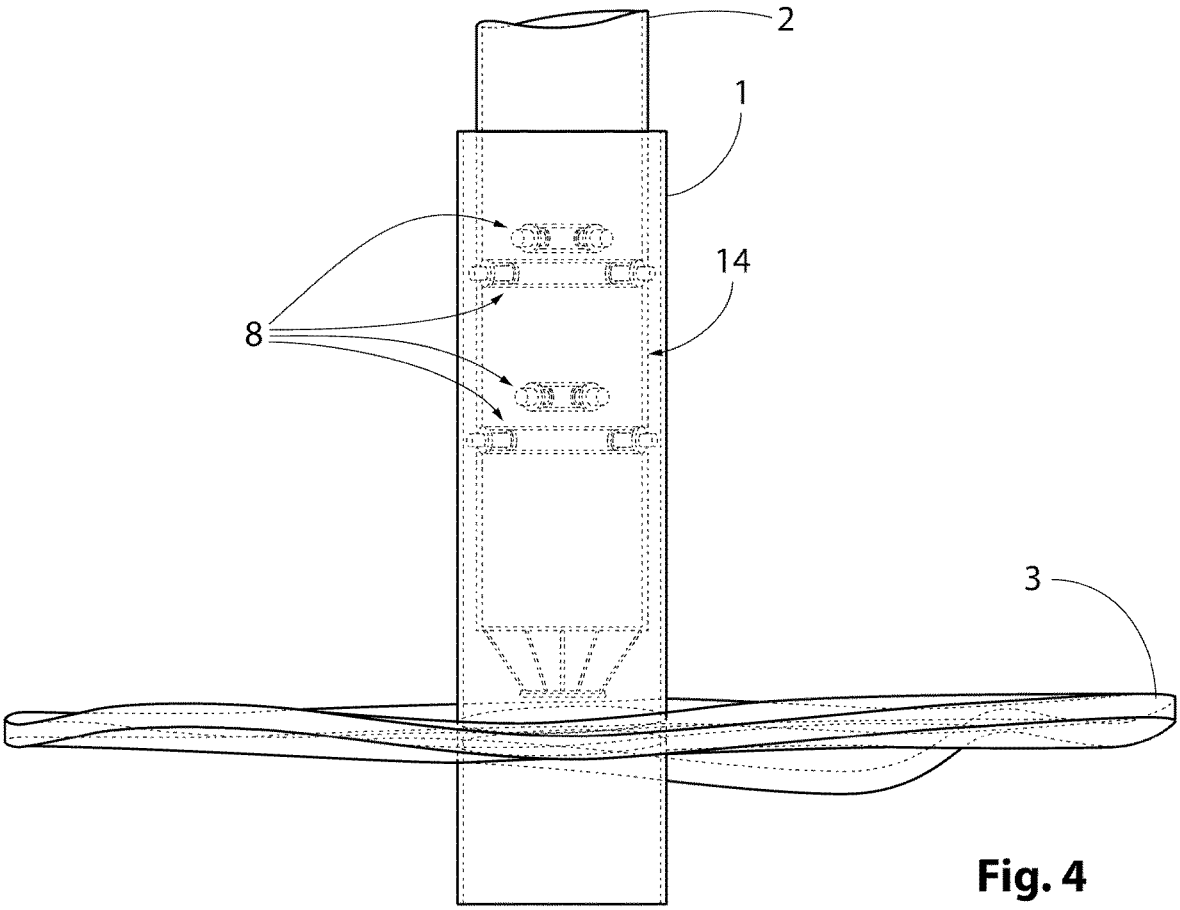
FIG. 4 Shows an illustration of a pile and part of a structure with multiple clamping assemblies 8 arranged at different distances from the top of the pile and at different orientations relative to the longitudinal axis of the pile.

FIG. 4 illustrates the use of clamping assemblies 8 of the form shown in FIG. 3. A structure 2 is shown fitted to a pile 1. The connecting portion 14 inside pile 1 is shown in ghost. A number of clamping assemblies 8 are shown fitted through the diameter of the connecting portion 14 to allow connection to the inside surface of pile 1.

Figure 5:
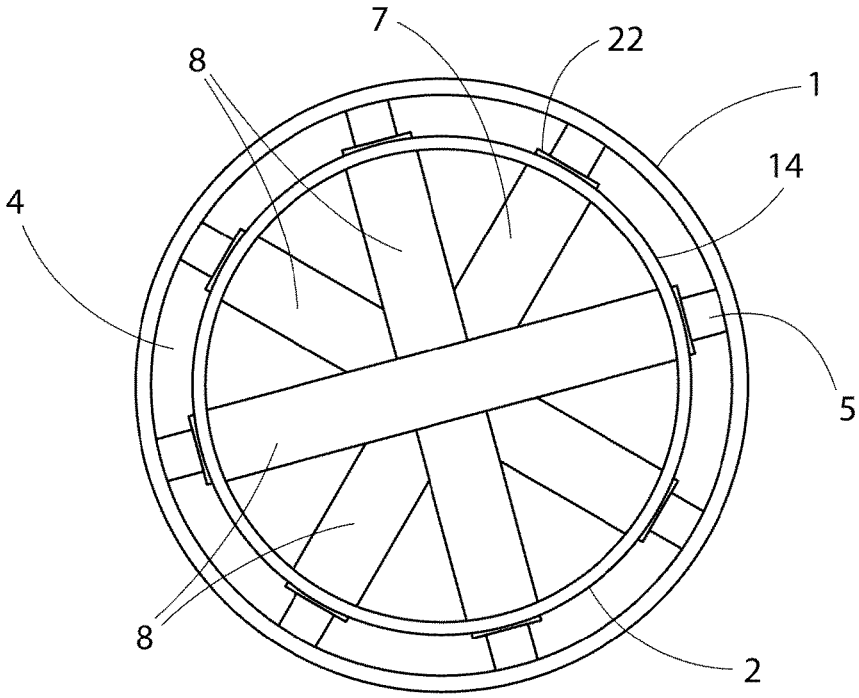
FIG. 5 Shows an illustration of a pile and part of a structure with multiple clamping assemblies 8 arranged at different distances from the top of the pile and at different orientations relative to the longitudinal axis of the pile as viewed from one end of the pile (i.e. a cross section view)

The operation of the clamping assemblies 8 can be seen more clearly in plan view FIG. 5. The clamping assemblies 8 are each fitted across a diameter of the connecting portion 14 of structure 2. Ends of the assemblies 8, for example ends 22 of tubular structures 7, can be welded to the wall of the connecting portion 14 to provide a strong fitting.

As depicted in FIG. 5 the connecting portion 14 is centred inside pile 1 and each of the piston 5 (clamping members) has been extended into gripping contact with the inside surface of the pile 1. The pistons 5 are spaced at equal intervals around the circumference of the connecting portion in this example, providing relatively evenly disposed gripping forces between pile 1 and structure 2. Arrangements where the pistons are not at equal spacings are also contemplated. The annulus 4 can then be filled with grout to form a permanent connection if required.

Figure 5A:
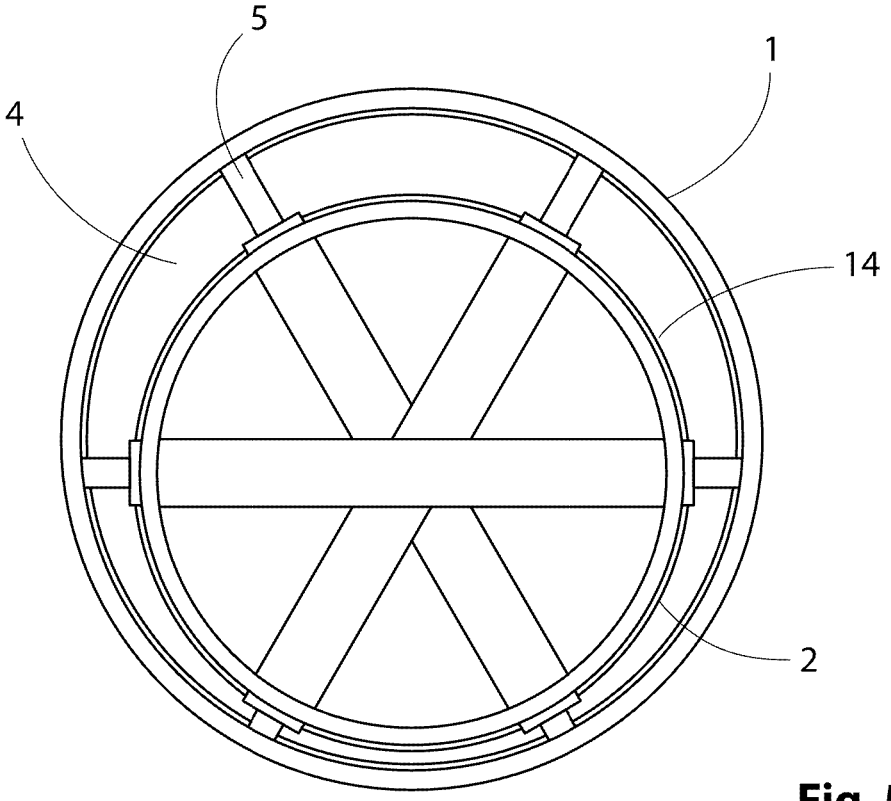
FIG. 5*a* shows an illustration similar to that of FIG. 5 but where the structure and pile are eccentric.

FIG. 5*a* shows the same view as FIG. 5 except that the connecting portion 14 of the structure 2 is not centred in the pile 1. This situation may occur where a structure 2 connects to more than one pile, such as the three legged jacket arrangement shown in FIG. 1. Small errors in positioning of the piles in the seabed may be expected, leading to off centre positioning of the connecting portions within the piles. As can be seen from FIG. 5*a* the pistons 5 can extend to different extents to form a secure connection between the structure 2 and the pile 1. As with the arrangement of FIG. 5 the annulus 4 may be filled with grout to form a permanent connection.

FIG. 6 shows in schematic detail part of the wall of a pile 1 with an approaching piston 5 as a clamping member. The end 9 of the piston 5 may be shaped or textured to improve engagement with the inside surface of the pile 1. FIG. 7 shows some options for texturing the contact surface of a clamping member (e.g. the end of a piston 5).

A series of protrusions 11 or ridges 10 can be used to increase the coefficient of friction between the clamping member and pile and so resist movement in a direction other than along the primary axis of the member. Depending on the specific materials employed in the manufacture of the clamping member and pile it may also be advantageous to create this shaped interface from a separate piece of material 12 which is then attached to the clamping member body (piston 5). In this manner the properties of different materials can be exploited to further increase the coefficient of friction between the clamping member and pile.

FIG. 6 shows in a cross section view similar to that of FIG. 1*a*, the use of the methods and apparatus of the invention. The jacket leg of a structure 2 has an end, acting as a connecting portion 14 fitted inside a seabed pile 1. The inside surface of pile 1 and the outside surface of connecting portion 14 are provided with grooves and/or ridges 16 along a length L1 to act as keys for grout. Two groups of clamping assemblies 8 are provided, one above length L1 and one below length L1. Each group of clamping assemblies 8 take the form of those depicted in FIGS. 3 to 5*a*, having pairs of diametrically opposed hydraulic cylinders 20 with pistons 5 (as clamping members) acting outwardly.

In the method, the pistons 5 grip the inside surface of the pile 1 with a substantial force applied by hydraulic pumping. Once a secure connection has been made between the pile 1 and the structure 2, the annulus 4 between them may be filled with grout. After the grout has set (typically 24 hours or more) the pressure in the hydraulic system may be relaxed as the solid grout now provides secure mechanical connection. Alternatively, the hydraulic cylinders may be retracted to leave only a grout connection between pile and structure. Voids left in the grout layer by retracting pistons may be filled with e.g. fluid, such as hydraulic fluid fed from small ports (not shown) in assemblies 8.

The invention claimed is:

1. A method for connecting a structure to a pile, the method comprising:

a) inserting a connecting portion of the structure inside the pile, wherein the connecting portion is adapted to include a plurality of radially disposed clamping members, which are extendible and retractable, wherein each clamping member is retractable to release gripping contact and, when fully retracted, is contained within a boundary of the connecting portion during the inserting step; and b) extending each of the plurality of clamping members beyond the boundary of the connecting portion into gripping contact with an inside surface of the pile, wherein each clamping member produces a gripping force acting on the inside surface of the pile.

2. The method of claim 1 wherein each of the plurality of clamping members is spaced apart axially on the connecting portion, so as to contact the inside surface of the pile at spaced apart locations including at least one of axially spaced apart locations and circumferentially spaced locations at axially spaced locations along a length of the pile.

3. The method of claim 1 wherein the clamping members are distributed axially and circumferentially on the connecting portion so as to contact the inside surface of the pile at substantially equally spaced intervals around its circumference when the clamping members are extended.

4. The method of claim 1 wherein the plurality of clamping members is fitted to a connecting portion in opposed pairs, to produce diametrically opposed gripping forces acting on the inside surface of the pile.

5. The method of claim 1 wherein the plurality of clamping members comprises a first and second group of clamping members, the first group is provided on the connecting portion at one location along a length of the connecting portion, and the second group is provided at a different location along the length of the connecting portion.

6. The method of claim 5 wherein the clamping members of each group of clamping members are arranged to contact the inside surface of the pile at spaced apart locations about the circumference of the pile.

7. The method of claim 1 wherein each of the plurality of clamping members each comprises a contact surface for contacting the inside surface of the pile, wherein the contact surface is shaped to conform to the inside surface of the pile.

8. The method of claim 1 wherein at least one of a contact surface of each clamping member or the inside surface of the pile is textured.

9. The method of claim 1 wherein the clamping members each comprise a piston, that extends from a hydraulic piston in cylinder arrangement.

10. The method of claim 9 wherein at least one of the clamping members consists of, or consists essentially of, the piston of the respective piston in cylinder arrangement, and an end of the piston contacts the inside surface of the pile with gripping contact.

11. The method of claim 9 wherein at least one of the clamping members comprises at least one of a shaped and a textured contact surface element for contacting the inside surface of the pile with gripping contact.

12. The method of claim 9 wherein the pistons are double acting.

13. The method of claim 1 wherein at least two clamping members are provided in a clamping assembly;

each clamping member comprises a piston that extends from a hydraulic piston in cylinder arrangement;

wherein each piston in cylinder arrangement is fitted to an end of a clamping assembly member and the pistons extend outwards from the assembly in opposite directions to provide diametrically opposed gripping forces acting on the inside surface of the pile.

14. The method of claim 13 wherein the clamping assembly member is a cylindrical tube.

15. The method of claim 1 wherein the clamping members each comprise the screw of a screw jack arrangement.

16. The method of claim 1 wherein clamping members are provided in a clamping assembly;

each clamping member of the assembly comprises a screw of a screw jack;

wherein each screw jack is fitted to an end of a clamping assembly member and the screws extend outwards from the assembly in opposite directions to provide diametrically opposed gripping forces acting on the inside surface of the pile.

17. The method of claim 1 further comprising inserting grout material into an annular space between the connecting portion and the inside surface of the pile when they are connected by the clamping members.

18. The method of claim 17 wherein at least one of the connecting portion and the inside surface of the pile is provided with texturing along a length;

wherein the plurality of clamping members comprises a first and second group of clamping members, the first group provided on the connecting portion at one location along its length, and the second group provided at a different location along the length of the connecting portion; and the first group of the plurality of clamping members is provided on the connecting portion above the surface texturing, and a second group of the plurality of clamping members provided below the surface texturing.

19. The method of claim 17, further comprising retracting the clamping members out of contact with the inside surface of the pile after the grout has set.

20. A method for connecting an offshore structure to a subsea pile, the method comprising:

a) inserting a connecting portion of the structure inside the subsea pile, wherein the connecting portion comprises a plurality of outwardly moveable clamping members; and b) outwardly moving each of the plurality of clamping members into gripping contact with an inside surface of the subsea pile;

c) inserting grout material into an annular space between the connecting portion and the inside surface of the pile when they are connected by the clamping members;

wherein at least one of the connecting portion or the inside surface of the pile is provided with texturing along a length;

wherein the plurality of clamping members comprises a first and second group of clamping members, the first group provided on the connecting portion at one location along its length, and the second group provided at a different location along the length of the connecting portion; and the first group of the plurality of clamping members is provided on the connecting portion above the surface texturing, and a second group of the plurality of clamping members provided below the surface texturing.

* * * * *